US010801730B2

(12) United States Patent
Kramer

(10) Patent No.: US 10,801,730 B2
(45) Date of Patent: Oct. 13, 2020

(54) COMBUSTOR PANEL MOUNTING SYSTEMS AND METHODS

(71) Applicant: United Technologies Corporation, Farmington, CT (US)

(72) Inventor: Stephen K. Kramer, Cromwell, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 631 days.

(21) Appl. No.: 15/485,278

(22) Filed: Apr. 12, 2017

(65) Prior Publication Data

US 2018/0299133 A1 Oct. 18, 2018

(51) Int. Cl.

| | |
|---|---|
| ***F23R 3/60*** | (2006.01) |
| ***F23R 3/00*** | (2006.01) |
| ***F23R 3/06*** | (2006.01) |
| ***F23M 5/04*** | (2006.01) |
| ***F23M 5/08*** | (2006.01) |

(52) U.S. Cl.

CPC ..... *F23R 3/60* (2013.01); *F23M 5/04* (2013.01); *F23M 5/085* (2013.01); *F23R 3/007* (2013.01); *F23R 3/06* (2013.01); *F23M 2900/05004* (2013.01); *F23R 3/002* (2013.01); *F23R 2900/00012* (2013.01); *F23R 2900/00017* (2013.01); *F23R 2900/03044* (2013.01)

(58) Field of Classification Search

CPC .... F23R 3/00; F23R 3/002; F23R 3/06; F23R 3/60

See application file for complete search history.

(56) References Cited

U.S. PATENT DOCUMENTS 4,380,896 A 4/1983 Wiebe
7,805,945 B2 * 10/2010 Grote ..... C21B 7/06 60/752

(Continued)

FOREIGN PATENT DOCUMENTS

EP 0706009 A2 4/1996
EP 2180256 A2 4/2010

(Continued)

OTHER PUBLICATIONS

European Search Report, European Application No. 18166994.6, dated Aug. 14, 2018, European Patent Office; EP Search Report 7 pages.

*Primary Examiner* — Craig Kim
(74) *Attorney, Agent, or Firm* — Cantor Colburn LLP

(57) ABSTRACT

Combustors of gas turbine engines having a combustor shell having a first end and a second end opposite the first end, a first securing element positioned at the first end of the combustor shell, a second securing element positioned at the second end of the combustor shell, a plurality of high temperature material panels fixedly secured by the first securing element at the first end and the second securing element at the second, wherein a panel gap is formed between edges of adjacent high temperature material panels of the plurality of high temperature material panels, and a seal divider extending from the first end to the second end and positioned on the combustor shell and arranged to seal the panel gap between adjacent first and second high temperature material panels.

18 Claims, 6 Drawing Sheets

(56) References Cited

U.S. PATENT DOCUMENTS

| | | | | |
|---|---|---|---|---|
| 7,908,867 | B2 * | 3/2011 | Keller | F01D 9/023 415/173.4 |
| 8,434,313 | B2 | 5/2013 | Tschuor et al. | |
| 9,423,129 | B2 | 8/2016 | Graves et al. | |
| 9,423,130 | B2 | 8/2016 | Prociw et al. | |
| 2015/0330633 | A1 | 11/2015 | Graves et al. | |
| 2016/0215980 | A1 | 7/2016 | Chang | |
| 2016/0230996 | A1 * | 8/2016 | Kostka | F23M 5/04 |
| 2016/0238247 | A1 * | 8/2016 | Staufer | F23R 3/26 |
| 2016/0252248 | A1 * | 9/2016 | Ruberte Sanchez | F23R 3/002 60/753 |

FOREIGN PATENT DOCUMENTS

| | | | | |
|---|---|---|---|---|
| EP | 3054218 | A1 | 8/2016 | |
| EP | 3056813 | | 8/2016 | |
| GB | 2432902 | A * | 6/2007 | F23R 3/50 |
| GB | 2432902 | A | 6/2007 | |

* cited by examiner

COMBUSTOR PANEL MOUNTING SYSTEMS AND METHODS

BACKGROUND

The subject matter disclosed herein generally relates to panels for combustors in gas turbine engines and, more particularly, to mounting systems and methods for combustor panels within gas turbine engines.

A combustor of a gas turbine engine may be configured and required to burn fuel in a minimum volume. Such configurations may place substantial heat load on the structure of the combustor (e.g., panels, shell, etc.). Such heat loads may dictate that special consideration is given to structures which may be configured as heat shields or panels configured to protect the walls of the combustor, with the heat shields being air cooled. Even with such configurations, excess temperatures at various locations may occur leading to oxidation, cracking, and high thermal stresses of the heat shields or panels. As such, impingement, effusion, and convective cooling of panels of the combustor wall may be used. Convective cooling may be achieved by air that is trapped between the panels and a shell of the combustor. Effusion cooling may be achieved by passing through the panels to cool the panels. Impingement cooling may be achieved by a process of directing relatively cool air from a location exterior to the combustor toward a back or underside of the panels.

It may be beneficial to operate gas turbine engines at higher than typical temperatures to be able to extract more efficiency from the system. However, such higher temperatures can be difficult to manage with respect to the components that form the combustion chambers. Accordingly, it may be beneficial to develop improved combustion chambers to withstand higher operating temperatures.

SUMMARY

According to some embodiments, combustors of gas turbine engines are provided. The combustors including a combustor shell having a first end and a second end opposite the first end, a first securing element positioned at the first end of the combustor shell, a second securing element positioned at the second end of the combustor shell, a plurality of high temperature material panels fixedly secured by the first securing element at the first end and the second securing element at the second, wherein a panel gap is formed between edges of adjacent high temperature material panels of the plurality of high temperature material panels, and a seal divider extending from the first end to the second end and positioned on the combustor shell and arranged to seal the panel gap between adjacent first and second high temperature material panels.

In addition to one or more of the features described above, or as an alternative, further embodiments of the combustors may include a plurality of biasing elements located away from the edges of the high temperature material panels, the biasing elements biasing the high temperature material panels to secure engagement with the first and second securing elements.

In addition to one or more of the features described above, or as an alternative, further embodiments of the combustors may include that the biasing elements are integrally formed from the combustor shell.

In addition to one or more of the features described above, or as an alternative, further embodiments of the combustors may include that the biasing elements are fixedly attached to the combustor shell.

In addition to one or more of the features described above, or as an alternative, further embodiments of the combustors may include that the combustor shell includes at least one cooling hole located proximate each biasing element to provide cooling thereto.

In addition to one or more of the features described above, or as an alternative, further embodiments of the combustors may include that the seal divider biases the first and second high temperature material panels into secure engagement with the first and second securing elements.

In addition to one or more of the features described above, or as an alternative, further embodiments of the combustors may include that the combustor shell includes at least one cooling hole located proximate the seal divider to provide cooling thereto.

In addition to one or more of the features described above, or as an alternative, further embodiments of the combustors may include that the high temperature material panels are formed from non-ductile materials.

In addition to one or more of the features described above, or as an alternative, further embodiments of the combustors may include that the high temperature material panels are formed from ceramic matrix composite.

In addition to one or more of the features described above, or as an alternative, further embodiments of the combustors may include that the first securing element is integrally formed with the combustor shell.

In addition to one or more of the features described above, or as an alternative, further embodiments of the combustors may include that the combustor shell includes at least one cooling hole proximate the first securing element to provide cooling thereto.

In addition to one or more of the features described above, or as an alternative, further embodiments of the combustors may include that the second securing element clips or slides into place to engage with both the high temperature material panels and the combustor shell at the second end.

According to some embodiments, methods of securing high temperature material panels to combustor shells of gas turbine engines are provided. The methods include engaging a first high temperature material panel to a first securing element positioned at a first end of a combustor shell, positioning and engaging a second high temperature material panel to the first securing element at the first end and adjacent the first high temperature material panel, locating a seal divider in a panel gap between the first and second high temperature material panels, and securely engaging the first and second high temperature material panels to the combustor shell with a second securing element at a second end of the combustor shell.

In addition to one or more of the features described above, or as an alternative, further embodiments of the methods may include positioning a plurality of biasing elements located away from the edges of the high temperature material panels, the biasing elements biasing the high temperature material panels into secure engagement with the first and second securing elements.

In addition to one or more of the features described above, or as an alternative, further embodiments of the methods may include that the biasing elements are integrally formed from the combustor shell or fixedly attached to the combustor shell.

In addition to one or more of the features described above, or as an alternative, further embodiments of the methods may include that the seal divider biases the first and second high temperature material panels into secure engagement with the first and second securing elements.

In addition to one or more of the features described above, or as an alternative, further embodiments of the methods may include that the high temperature material panels are formed from non-ductile materials.

In addition to one or more of the features described above, or as an alternative, further embodiments of the methods may include that the high temperature material panels are formed from ceramic matrix composite.

In addition to one or more of the features described above, or as an alternative, further embodiments of the methods may include integrally forming the first securing element with the combustor shell.

In addition to one or more of the features described above, or as an alternative, further embodiments of the methods may include that the second securing element clips or slides into place to engage with both the high temperature material panels and the combustor shell at the second end.

Technical effects of embodiments of the present disclosure include mounting systems for high temperature material panels to be employed in gas turbine engines. Further technical effects include the use of discrete panels in place of full hoop configurations.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
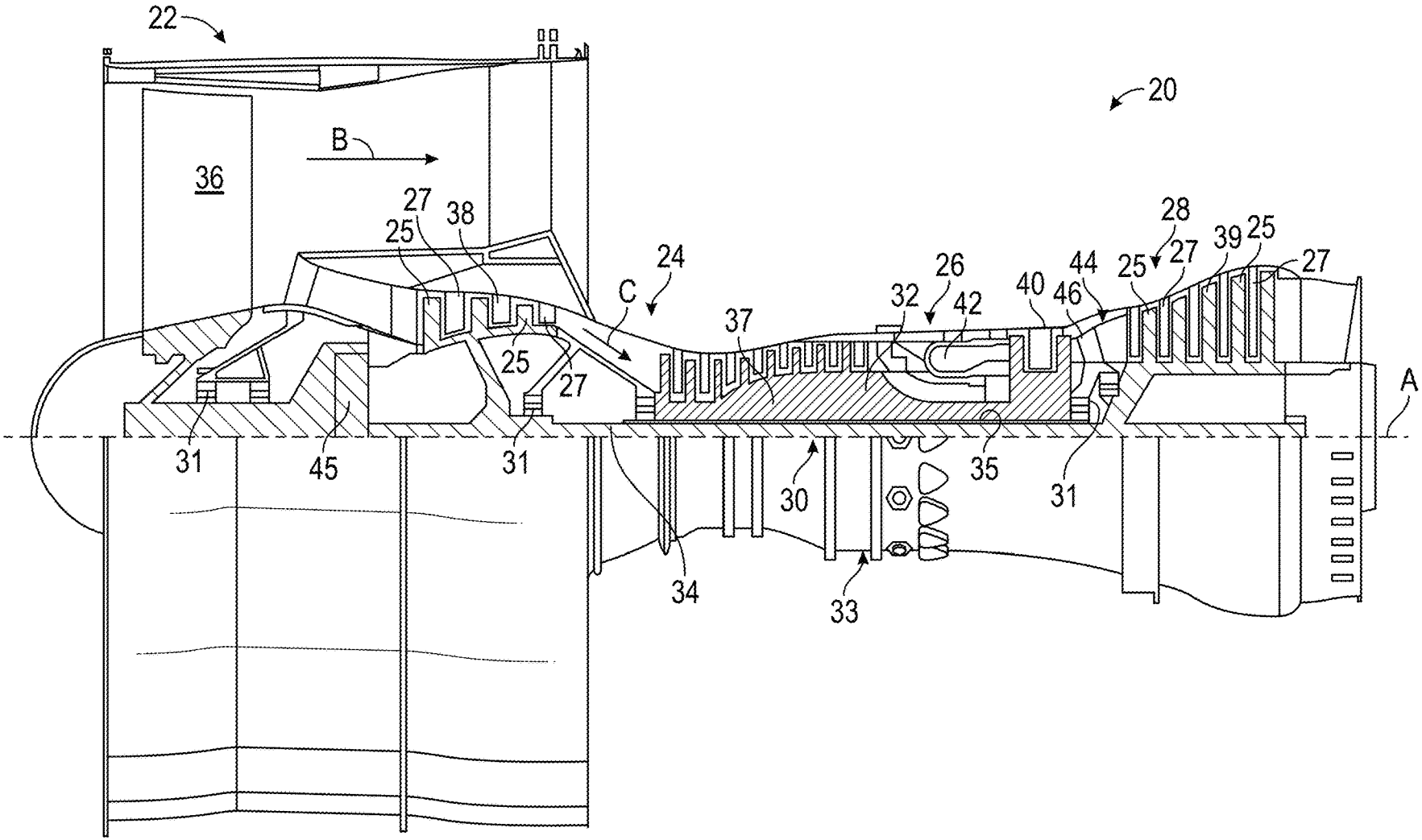
FIG. 1 is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 schematically illustrates a gas turbine engine 20. The gas turbine engine 20, as shown, is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, single-spool, three-spool, etc. engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet (10,668 meter). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where $T_{ram}$ represents the ambient temperature in degrees Rankine. The Low Corrected Fan Tip Speed according to one non-limiting embodiment of the example gas turbine engine 20 is less than about 1150 feet per second (fps) (351 meters per second (m/s)).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Figure 2A:
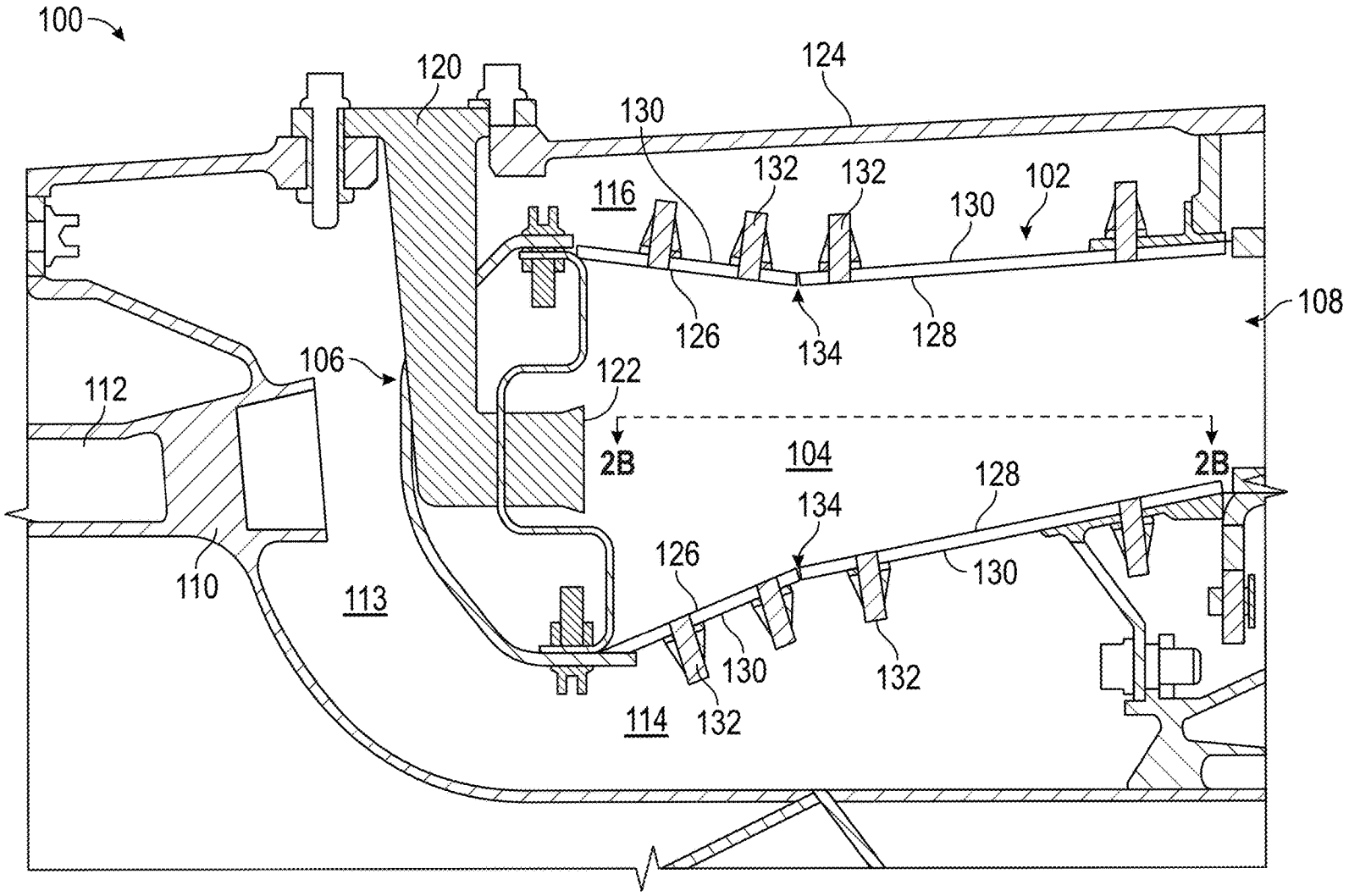
FIG. 2A (Prior Art)
FIG. 2A is a schematic illustration of a combustor section of a gas turbine engine that may employ various embodiments disclosed herein.

FIG. 2A is a schematic illustration of a configuration of a combustion section 100 of a gas turbine engine. As shown, a combustor 102 defines a combustion chamber 104. The combustor 102 includes an inlet 106 and an outlet 108 through which air may pass. The air may be supplied to the combustor 102 by a pre-diffuser 110.

In the configuration shown in FIG. 2A, air is supplied from a compressor into an exit guide vane 112, as will be appreciated by those of skill in the art. The exit guide vane 112 is configured to direct the airflow into the pre-diffuser 110, which then directs the airflow toward the combustor 102. The combustor 102 and the pre-diffuser 110 are separated by a shroud chamber 113 that contains the combustor 102 and includes an inner diameter branch 114 and an outer diameter branch 116. As air enters the shroud chamber 113 a portion of the air may flow into the combustor inlet 106, a portion may flow into the inner diameter branch 114, and a portion may flow into the outer diameter branch 116. The air from the inner diameter branch 114 and the outer diameter branch 116 may then enter the combustion chamber 104 by means of one or more nozzles, holes, apertures, etc. The air may then exit the combustion chamber 104 through the combustor outlet 108. At the same time, fuel may be supplied into the combustion chamber 104 from a fuel injector 120 and a pilot nozzle 122, which may be ignited within the combustion chamber 104. The combustor 102 of the engine combustor section 100 may be housed within a shroud case 124 which may define the shroud chamber 113.

Figure 2B:
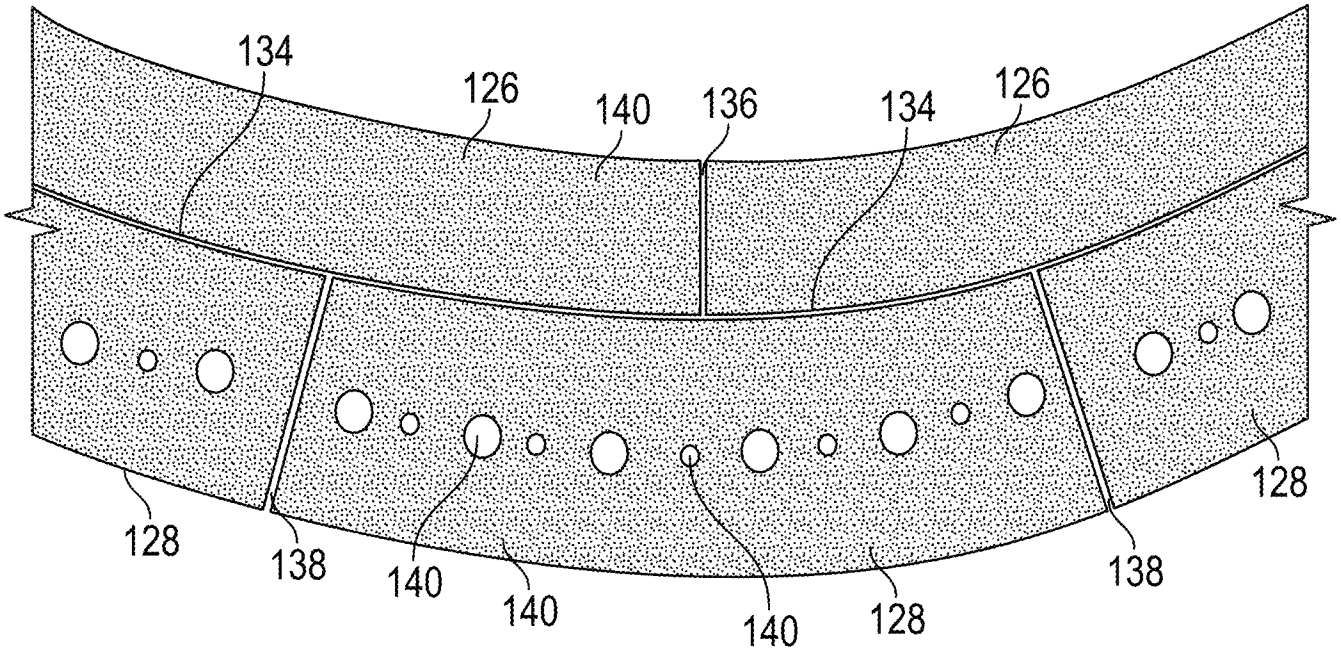
FIG. 2B (Prior Art)
FIG. 2B is a schematic illustration of combustor panels of the combustor section of FIG. 2A as viewed along the line 2B-2B.

The combustor 102, as shown in FIGS. 2A-2B, includes multiple panels 126, 128 that are mounted on an interior surface of one or more shells 130 and are arranged parallel to the shells 130. The shells 130 can define circular or annular structures with the panels 126, 128 being mounted on an inner diameter shell and an outer diameter shell, as will be appreciated by those of skill in the art. The panels 126, 128 can be removably mounted to the shell 130 by one or more attachment mechanisms 132. In some embodiments, the attachment mechanism 132 may be integrally formed with a respective panel 126, 128, although other configurations are possible. In some embodiments, the attachment mechanism 132 may be a bolt or other structure that may extend from the respective panel 126, 128 through the interior surface to a receiving portion or aperture of the shell 130 such that the panel 126, 128 may be attached to the shell 130 and held in place.

The panels 126, 128 include a plurality of cooling holes and/or apertures to enable fluid, such as gases, to flow from areas external to the combustion chamber 104 into the combustion chamber 104. Impingement cooling may be provided from the shell-side of the panels 126, 128, with hot gases may be in contact with the combustion-side of the panels 126, 128. That is, hot gases may be in contact with a surface of the panels 126, 128 that is facing the combustion chamber 104.

First panels 126 may be configured about the inlet 106 of the combustor 102 and may be referred to as forward panels. Second panels 128 may be positioned axially rearward and adjacent the first panels 126, and may be referred to as aft panels. The first panels 126 and the second panels 128 are configured with a gap 134 formed between axially adjacent first panels 126 and second panels 128. The gap 134 may be a circumferentially extending gap that extends about a circumference of the combustor 102. A plurality of first panels 126 and second panels 128 may be attached and extend about an inner diameter of the combustor 102, and a separate plurality of first and second panels 126, 128 may be attached and extend about an outer diameter of the combustor 102, as known in the art. As such, axially extending gaps may be formed between two circumferentially adjacent first panels 126 and between two circumferentially adjacent second panels 128.

Turning now to FIG. 2B, an illustration of a configuration of the panels 126, 128 installed within the combustor 102 is shown, as viewed along the line 2B-2B shown in FIG. 2A. The first panels 126 are installed to extend circumferentially about the combustion chamber 104 and form first axially extending gaps 136 between circumferentially adjacent first panels 126. Similarly, the second panels 128 are installed to extend circumferentially about the combustion chamber 104 and second axially extending gaps 138 are formed between circumferentially adjacent second panels 128. Moreover, as shown, the circumferentially extending gap 134 is shown between axially adjacent first and second panels 126, 128. Also shown in FIG. 2B are the various cooling holes, apertures, and other fluid flow paths 140 that are formed in the surfaces of the panels 126, 128. The flow paths 140 may be impingement holes, effusions holes, quench holes, and/or other types of cooling or fluid injection apertures formed in the panels 126, 128. Further, the combustor shell 130 can include similar or associated flow paths to provide back-side cooling to the panels 126, 128 and/or to enable cooling flow to enter into the combustion chamber 104.

The gaps 134, 136, and 138 may enable movement and/or thermal expansion of various panels 126, 128 such that room is provided to accommodate such movement and/or changes in shape or size of the panels 126, 128. Leakage or purge gases may flow into the combustion chamber 104 through the gaps 134, 136, and 138. In some embodiments, cooling flow may be provided to an exterior side of the panels 126, 128 to provide cooling to the combustor 102. Flowing in the opposite direction, hot gas may ingest or flow from the combustion chamber 104 outward through the gaps 134, 136, and 138. Hot gas injecting through the gaps 134, 136, and 138 may cause damage and/or wear on the material of the panels 126, 128.

As shown in FIGS. 2A-2B, the combustor 102 has a double wall system, where the panels 126, 128, which can be cast from a high temperature nickel alloy, are mounted to the shell 130. This allows the shell 130 to carry a structural load as well as the majority of a pressure drop across the system, while the panels 126, 128 are arranged to carry heat loads within the combustor 102. As such, the panels 126, 128 can be allowed to grow thermally as heat is applied to the panels 126, 128. In some embodiments, the panels 126, 128 can be made of materials that have lower strength with higher oxidation resistance and melt points than the shell 130.

In modern aircraft, it may be advantageous to increase operating pressure ratios and temperatures. Because of this increase in various operating parameters, traditional material selected for the panels 126, 128 (e.g., metal) may not be sufficient, leading to early failure due to oxidation or melting. Accordingly, it may be desirable to be able to use higher temperature materials, such as ceramics, ceramic matric composites, composites, etc., in double-wall systems (e.g., as shown in FIGS. 2A-2B). However, a drawback to such high-temperature materials is that panels made from such materials may be non-ductile, and local attachment points (e.g., attachment mechanism 132) can be sources of high stress, which in some instances may lead to failure of the panel at the location of high stress. Thus, it may be advantageous to develop mechanisms to allow for low-ductile, high-temperature materials to be employed for combustor panels.

One solution may be a single-wall solution. However, a double-wall solution may be more efficient, durable, and lower cost (e.g., easier to maintain, manufacture, etc.). A double-wall combustor system can be employed using full hoop ceramic rings, which has advantages similar to metal double-wall systems. Backside impingement cooling can be used to tailor the temperatures around the ceramic rings to be relatively or substantially uniform to reduce thermal stress. The full hoops can be trapped in place, with no attachments or small features needed. However, the challenge with full-hoop configurations is that manufacture and installation of full-hoop ceramic panels can reduce processing rates for manufacture of gas turbine engines. Further, flaws within the full-hoop ceramic panels can cause the entire hoop to be rejected. Additionally any failures during use may result in the replacement of the entire full-hoop panel. Accordingly, a system implementing less than full-hoop panels is desirable to enable the benefits of ceramic panels while also avoiding the various issues of full-hoop solutions.

Embodiments provided herein are directed to non-full-hoop systems with high temperature (e.g., non-ductile materials, ceramic, composite, ceramic matrix composite, etc.) panels. For example, embodiments provided herein employ features that trap the high temperature panels as well as spring load the panels against the trapping features. In various embodiments, as will be appreciated in view of the present disclosure, the trapping features can be both integral to the combustor shell as well as separate frames that work with features on the combustor shell. As defined herein, "high temperature materials" refers to materials that are rated for temperatures at or above 1,000° F. (538° C.) and can include non-ductile materials, ceramics, composites, ceramic matrix composites, or other materials.

Figure 3:
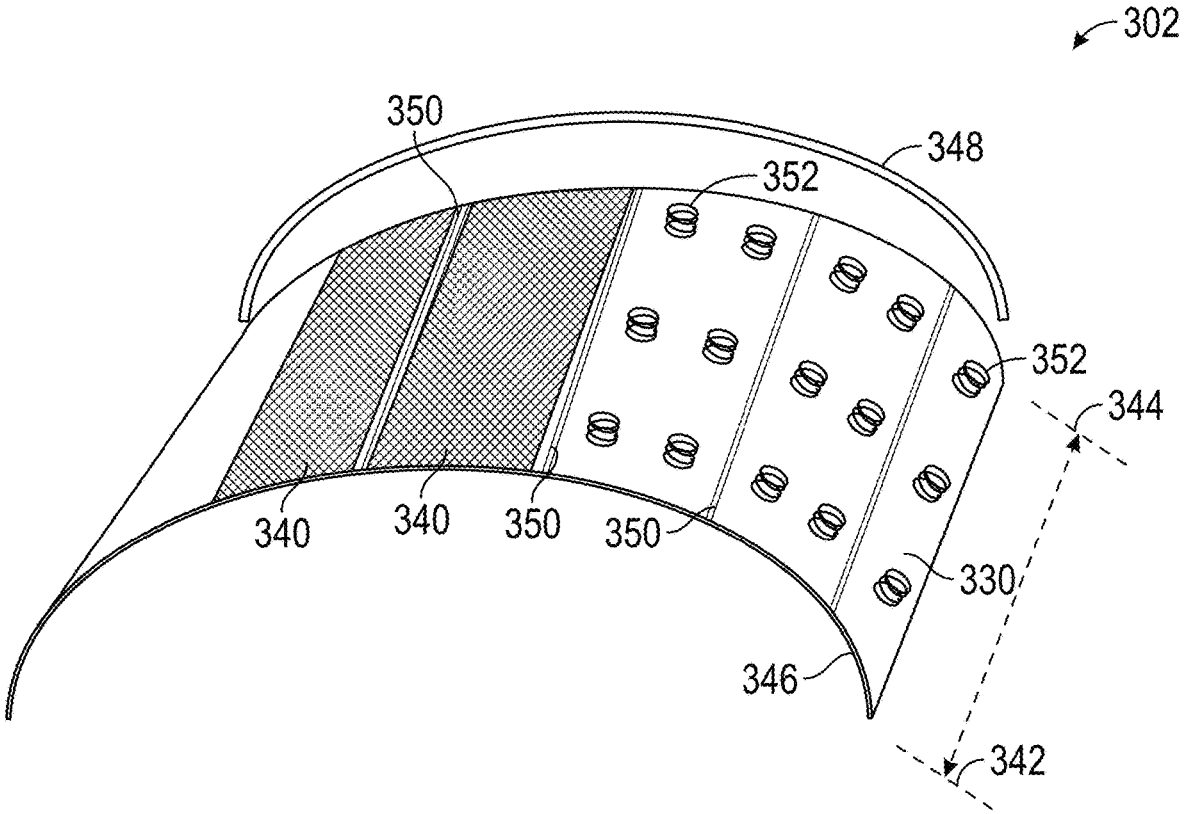
FIG. 3 is a side view schematic illustration of a portion of a combustor having a panel mounting system in accordance with an embodiment of the present disclosure.

Turning now to FIG. 3, a schematic illustration of a portion of a combustor 302 having a panel mounting system in accordance with an embodiment of the present disclosure is shown. As illustratively shown, a combustor shell 330 is shown and a plurality of high temperature material panels 340 can be installed thereto. As shown, the combustor shell 330 represents an inner diameter shell of the combustor 302. Those of skill in the art will appreciate that the teachings provided herein can be equally applied to an outer diameter combustor shell.

The high temperature material panels 340 are installed such that the high temperature material panels 340 extend from a first end 342 of the combustor shell 330 to a second end 344. In some arrangements, the first end 342 can be a leading or forward end of the combustor 302 and the second end 344 can be a trailing or aft end of the combustor 302. In such arrangements, the high temperature material panels 340 are full-length panels, and thus separate forward and aft panels (e.g., as shown in FIGS. 2A-2B) are not required.

The high temperature material panels 340 are arranged to be secured in place at the first end 342 and the second end 344 to the combustor shell 330. The securing is achieved using a panel mounting system in accordance with the present disclosure. The panel mounting system includes various features that fixedly secure yet allow for effective ductility to non-ductile panels. FIG. 3 illustrates a non-limiting embodiment of a panel mounting system in accordance with the present disclosure.

For example, a first securing element 346 is positioned at the first end 342 and is configured to securely hold or trap a first end of the high temperature material panels 340 against the combustor shell 330. A second securing element 348 is positioned at the second end 344 and is configured to securely hold or trap a second end of the high temperature material panels 340 against the combustor shell 330. In some embodiments, the first securing element 346 can be integrally part of and/or formed with the combustor shell 330 and the second securing element 348 can be a separate feature that can be placed over or engage with the high temperature material panels 340 and the combustor shell 330. In other embodiments, the reverse of such arrangement may be true. Further, in some embodiments, both the first and second securing elements can be separate structures or both may be part of the combustor shell or the high temperature material panels.

As schematically shown, seal dividers 350 are located between adjacent high temperature material panels 340 or between the locations for high temperature material panels 340. The seal dividers 350 can be ridges or similar structures that are located between installed high temperature material panels 340 to seal a gap that may exist therebetween. The seal dividers 350 can thus prevent and/or seal air flow and reduce leakage between high temperature material panels 340. As shown, because the high temperature material panels 340 are full-length panels, the dividers are full length and extend from the first end 342 to the second end 344 of the combustor shell 330. The seal dividers 350 can be integral to the combustor shell 330 or may be separate components, such as separate metal "gaskets." In some embodiments, the seal dividers 350 can engage with or retain the high temperature material panels 340 or the high temperature material panels 340 can be retained or urged against the seal dividers 350 or combinations thereof. In some embodiments, the seal dividers 350 can be a frame or other structural feature.

Also shown in FIG. 3, the combustor shell 330 includes a plurality of biasing elements 352. The biasing elements 352 are arranged such that when a high temperature material panel 340 is placed over the biasing elements 352 and retained by the first and second securing elements 346, 348, the biasing elements 352 urge the high temperature material panels 340 against and into secure engagement with the first and second securing elements 346, 348. That is, as installed, a high temperature material panel 340 is retained to the combustor shell 330 between the first and second securing elements 346, 348 at the first and second ends 342, 344 and the biasing elements 352 at locations between the first and second ends 342, 344. In some embodiments the biasing elements 352 can be integrally formed with and/or as part of the combustor shell 330 and in other embodiments the biasing elements 352 can be separate elements that are installed between and/or attached to one or both of the combustor shell 330 and the high temperature material panels 340. The biasing elements 352 will force or urge the high temperature material panels 340 against the first and second securing elements 346, 348 at the ends thereof and thus leakages can be reduced.

Figure 4:
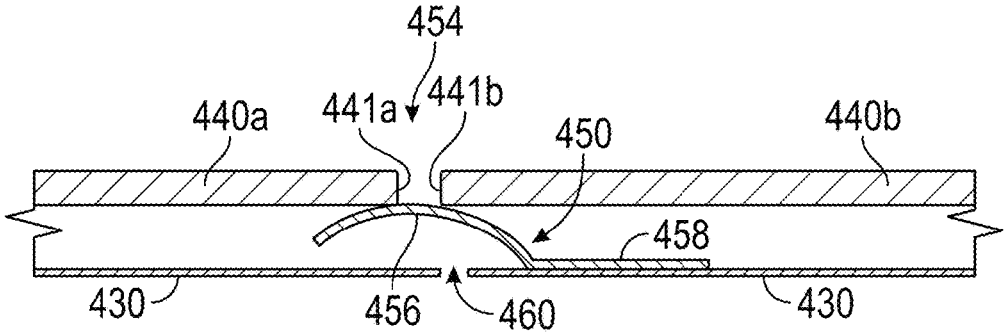
FIG. 4 is a schematic illustration of a seal divider in accordance with an embodiment of the present disclosure.

Turning now to FIG. 4, a schematic illustration of a seal divider 450 in accordance with an embodiment of the present disclosure is shown. The seal divider 450 in the present embodiment is a separate element or component that is welded or otherwise affixed or attached to a portion of a combustor shell 430. As shown, a first high temperature material panel 440*a* and a second high temperature material panel 440*b* are positioned above the combustor shell 430. Although not shown, the first and second high temperature material panels 440*a*, 440*b* are secured or retained at ends thereof, such as shown in FIG. 3.

A panel gap 454 exists between the edges 441*a*, 441*b* of adjacently placed first and second high temperature material panels 440*a*, 440*b*. The panel gap 454 is sealed by a sealing portion 456 of the seal divider 450. As shown, the sealing portion 456 is an arcuate bend that the first and second high temperature material panels 440*a*, 440*b* can engage or be urged against to seal the panel gap 454. An attachment portion 458 of the seal divider 450 is fixedly attached to the combustor shell 430. In some embodiments, the attachment portion 458 can be welded, brazed, or otherwise fixedly attached to the combustor shell 430. In other embodiments, fasteners, adhesives, or other attaching mechanisms and/or means can be employed to fixedly attach the seal divider 450 to the combustor shell 430.

In some embodiments, the seal divider 450 can also operate as a biasing element and thus may replace or operate in concert with other biasing elements (e.g., biasing elements 352 shown in FIG. 3). For example, in the embodiment of FIG. 4, the sealing portion 456 is curved and can function as a spring ridge or leaf spring to bias upward in FIG. 4, and thus urge the first and second high temperature material panels 440*a*, 440*b* against securing elements that are located at the ends of the first and second high temperature material panels 440*a*, 440*b*.

Also schematically shown in FIG. 4, a cooling hole 460 can be formed within the combustor shell 430 to enable impingement cooling to cool the seal divider 450. In some embodiments, the cooling hole 460 can be substantially similar to impingement and/or effusion holes formed in the combustor shell 430. Thus, cooling can be provided to the seal divider 450. In some embodiments, the seal divider 450 can be formed from a metal or other ductile material, whereas the first and second high temperature material panels 440*a*, 440*b* are formed from high temperature materials, such as non-metallic composites and may be non-ductile. In such embodiments, because the seal divider 450 is metal and thus a lower temperature material than the first and second high temperature material panels 440*a*, 440*b*, cooling can be provided to improve efficiency and/or product life.

Figure 5:
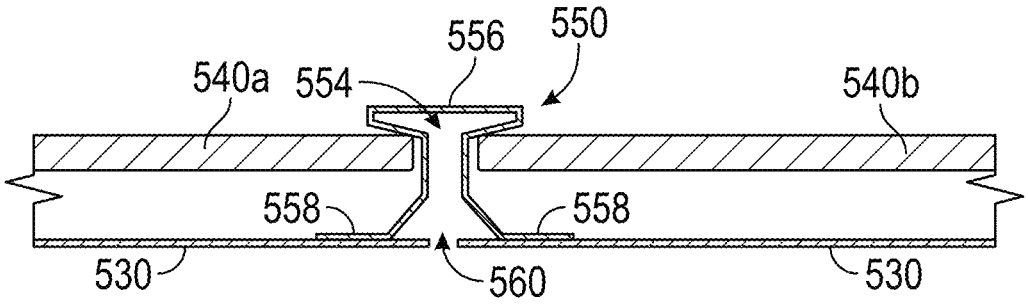
FIG. 5 is a schematic illustration of another seal divider in accordance with an embodiment of the present disclosure.

Turning now to FIG. 5, a schematic illustration of an alternative configuration of a seal divider 550 in accordance with an embodiment of the present disclosure is shown. The seal divider 550 in the present embodiment is a separate element or component that is welded or otherwise affixed or attached to a portion of a combustor shell 530. As shown, a first high temperature material panel 540*a* and a second high temperature material panel 540*b* are positioned above the combustor shell 530. Although not shown, the first and second high temperature material panels 540*a*, 540*b* are secured or retained at ends thereof, such as shown in FIG. 3.

Similar to that shown and described above, a panel gap 554 exists between the adjacently placed first and second high temperature material panels 540*a*, 540*b*. The panel gap 554 is sealed by a sealing portion 556 of the seal divider 550. As shown, the sealing portion 556 is a frame structure that extends above the first and second high temperature material panels 540*a*, 540*b*, e.g., into a combustion chamber. The frame structure of the sealing portion 556 can engage with top surfaces of the first and second high temperature material panels 540*a*, 540*b* to seal the panel gap 554. Similar to the embodiment described above, an attachment portion 558 of the seal divider 550 is fixedly attached to the combustor shell 530. In this embodiment, the attachment portion 558 extends on both sides of a cooling hole 560. In some embodiments, the attachment portions 558 can be welded, brazed, or otherwise fixedly attached to the combustor shell 530. In other embodiments, fasteners, adhesives, or other attaching mechanisms and/or means can be employed to fixedly attach the seal divider 550 to the combustor shell 530.

Figure 6:
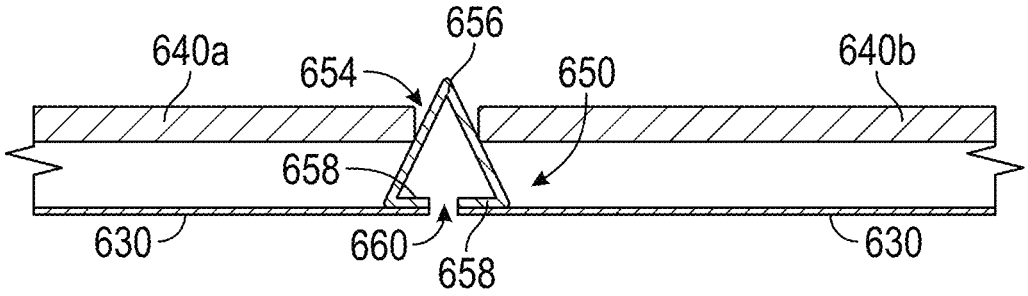
FIG. 6 is a schematic illustration of another seal divider in accordance with an embodiment of the present disclosure.

Turning now to FIG. 6, a schematic illustration of an alternative configuration of a seal divider 650 in accordance with an embodiment of the present disclosure is shown. The seal divider 650 in the present embodiment is a separate element or component that is welded or otherwise affixed or attached to a portion of a combustor shell 630. As shown, a first high temperature material panel 640*a* and a second high temperature material panel 640*b* are positioned above the combustor shell 630. Although not shown, the first and second high temperature material panels 640*a*, 640*b* are secured or retained at ends thereof, such as shown in FIG. 3.

Similar to that shown and described above, a panel gap 654 exists between the adjacently placed first and second high temperature material panels 640*a*, 640*b*. The panel gap 654 is sealed by a sealing portion 656 of the seal divider 650. As shown, the sealing portion 656 is a triangular structure that extends from the combustor shell 630 and into the panel gap 654. The seal divider 650 of this arrangement can be rigid or ductile, and in some embodiments can be arranged and configured to act as a biasing element similar to that described with respect to FIG. 4. Similar to the embodiment described above, an attachment portion 658 of the seal divider 650 is fixedly attached to the combustor shell 630. In this embodiment, the attachment portion 658 extends on both sides of a cooling hole 660. In some embodiments, the attachment portions 658 can be welded, brazed, or otherwise fixedly attached to the combustor shell 630. In other embodiments, fasteners, adhesives, or other attaching mechanisms and/or means can be employed to fixedly attach the seal divider 650 to the combustor shell 630.

Although FIGS. 4-6 provide various example arrangements and geometries of the seal dividers, those of skill in the art will appreciate that other geometries and/or structures can be employed without departing from the scope of the present disclosure. That is, the embodiments of FIGS. 4-6 are provided for illustrative and explanatory purposes and are not intended to be limiting. Further, although described above as welded or otherwise attached/fixed to the combustor shell, in some embodiments, the seal dividers can be held in place or retained by the securing elements that are located at the forward and aft ends of the combustor shell (e.g., securing elements 346, 348 shown in FIG. 3).

Figure 7:
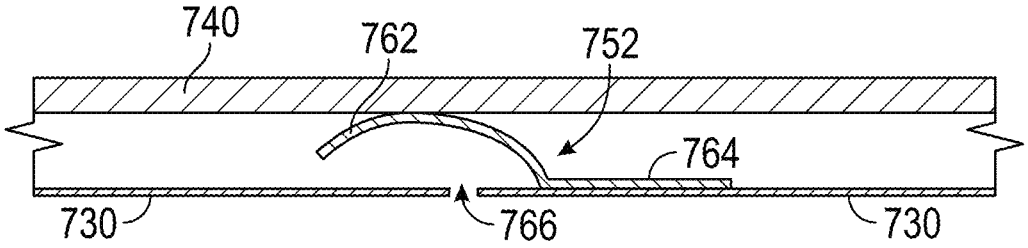
FIG. 7 is a schematic illustration of a biasing element in accordance with an embodiment of the present disclosure.

Turning now to FIG. 7, a schematic illustration of a biasing element 752 in accordance with an embodiment of the present disclosure is shown. The biasing element 752 in the present embodiment is a separate element or component that is welded or otherwise affixed or attached to a portion of a combustor shell 730. The biasing element 752 can be a linear element, e.g., extending from a first end to a second end of the combustor shell 730 (e.g., see FIG. 3). In other embodiments, the biasing element 752 can be a discrete element that only biases against a high temperature material panel 740 at one specific or localized location (e.g., as shown in FIG. 3). The high temperature material panel 740 is positioned above the combustor shell 730 and biased away from the combustor shell 730 by the biasing element 752. Although not shown, the high temperature material panel 740 is secured or retained at ends thereof, such as shown in FIG. 3. The biasing element 752 is positioned away from the edges of the high temperature material panel 740 (e.g., not located at the panel gaps shown in FIGS. 4-6).

The biasing element 752 includes a biasing portion 762 and an attachment portion 764. The biasing portion 762 is curved and can function as a spring ridge or leaf spring to bias upward in FIG. 7, and thus urge the high temperature material panel 740 against securing elements that are located at the ends of the high temperature material panel 740, as described above. The attachment portion 764 of the biasing element 752 is fixedly attached to the combustor shell 730. In some embodiments, the attachment portions 764 can be welded, brazed, or otherwise fixedly attached to the combustor shell 730. In other embodiments, fasteners, adhesives, or other attaching mechanisms and/or means can be employed to fixedly attach the biasing element 752 to the combustor shell 730.

Also schematically shown in FIG. 7, a cooling hole 766 can be formed within the combustor shell 730 to enable impingement cooling to cool the biasing element 752. In some embodiments, the cooling hole 766 can be substantially similar to impingement and/or effusion holes formed in the combustor shell 730. Thus, cooling can be provided to the biasing element 752. In some embodiments, the biasing element 752 can be formed from a metal or other ductile material, whereas the high temperature material panel 740 is formed from high temperature materials, such as non-metallic composites and may be non-ductile. In such embodiments, because the biasing element 752 is metal and thus a lower temperature material than the high temperature material panel 740, cooling can be provided to improve efficiency and/or product life. The biasing portion 762 of the biasing element 752 can take various geometric shapes or structures. For example, the biasing portion 762 can be a spiral, ridge, bowed, bent, angled, or otherwise extend from the attachment portion 764.

Figure 8:
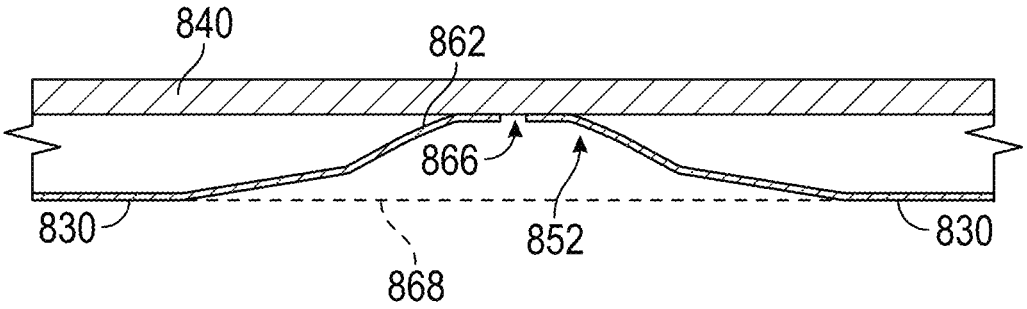
FIG. 8 is a schematic illustration of another biasing element in accordance with an embodiment of the present disclosure.

Turning now to FIG. 8, a schematic illustration of another biasing element 852 in accordance with an embodiment of the present disclosure is shown. The biasing element 852 in the present embodiment is integrally part of and/or formed from a combustor shell 830. The biasing element 852 is a feature that is formed at a discrete location on the combustor shell 830 and biases against a high temperature material panel 840 at one specific or localized location (e.g., as shown in FIG. 3). The high temperature material panel 840 is positioned above the combustor shell 830 and biased away from the combustor shell 830 by the biasing element 852. Although not shown, the high temperature material panel 840 is secured or retained at ends thereof, such as shown in FIG. 3. The biasing element 852 is formed at a position that is away from the edges of the high temperature material panel 840 when the high temperature material panel 840 is installed to the combustor shell 830 (e.g., not located at the panel gaps shown in FIGS. 4-6).

The biasing element 852 includes a biasing portion 862 that extends from a plane 868 defined by the combustor shell 830 in an area proximate the biasing element 852. The biasing portion 862 is curved and can function as a spring ridge or leaf spring to bias upward in FIG. 8, and thus urge the high temperature material panel 840 against securing elements that are located at the ends of the high temperature material panel 840, as described above. The biasing portion 862 (and the biasing element 852) can be a spring-like feature that is integral with the combustor shell 830, and may be a bump, spiral cut, or other structural feature. Also schematically shown in FIG. 8, a cooling hole 866 can be formed within the combustor shell 830 and the biasing element 852 to enable impingement cooling to cool the high temperature material panel 840. In some embodiments, the cooling hole 866 can be substantially similar to impingement and/or effusion holes formed in the combustor shell 830. Thus, cooling can be provided to the biasing element 852 and to a back side of the high temperature material panel 840. In some embodiments, the cooling hole 866 can be provided to minimize fretting at the contact between the high temperature material panel 840 and the combustor shell 830 at the biasing element 852.

In this configuration, the biasing element 852 is formed from the material of the combustor shell 830, and may be metal or other ductile material, whereas the high temperature material panel 840 is formed from high temperature materials, such as non-metallic composites and may be non-ductile. In such embodiments, because the biasing element 852 is metal and thus a lower temperature material than the high temperature material panel 840, cooling can be provided to improve efficiency and/or product life. As noted above, and in the present embodiment, the biasing portion 862 of the biasing element 852 can take various geometric shapes or structures. For example, the biasing portion 862 can be a spiral, ridge, bowed, bent, angled, or otherwise extend from the plane 868 of the combustor shell 830.

Figure 9:
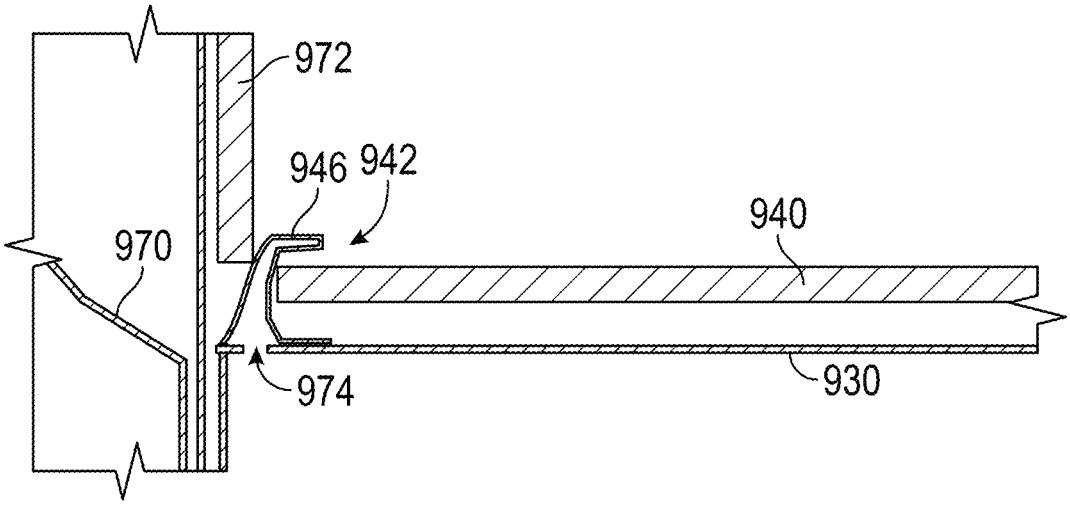
FIG. 9 is a schematic illustration of a first securing element in accordance with an embodiment of the present disclosure.

Turning now to FIG. 9, a schematic illustration of a first securing element 946 in accordance with an embodiment of the present disclosure is shown. The first securing element 946 is located at a forward or leading end 942 of a combustor and a hood 970 and bulkhead 972 are shown. The combustor of FIG. 9 has a combustor shell 930 and a plurality of high temperature material panels 940 mounted thereto. The high temperature material panel 940 can be substantially similar to that shown and described above. The high temperature material panel 940 is retained and secured within the combustor at the first end 942 by the first securing element 946. The first securing element 946 can be a ring-like structure that extends around the circumferential shape of the combustor shell 930. In some non-limiting embodiments, the first securing element 946 can be attached to the combustor shell 930, such as by welding or other attachment means or mechanism. In other non-limiting embodiments, the first securing element 946 can be integrally formed with the combustor shell 930. As illustratively shown, the combustor shell 930 can also include cooling holes 974 that provide cooling beneath and/or into the first securing element 946. As schematically shown, the first securing element 946 can also engage with and secure the bulkhead 972 in place.

Figure 10:
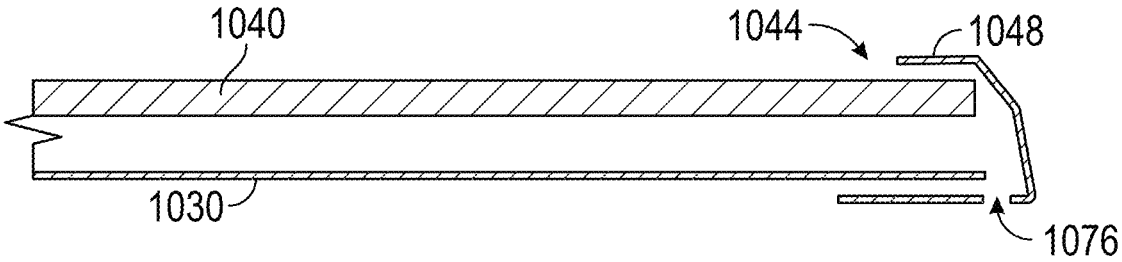
FIG. 10 is a schematic illustration of a second securing element in accordance with an embodiment of the present disclosure.

Turning now to FIG. 10, a schematic illustration of a second securing element 1048 in accordance with an embodiment of the present disclosure is shown. The second securing element 1048 is located at an aft or trailing end 1044 of a combustor (e.g., see FIG. 3). The combustor of FIG. 10 has a combustor shell 1030 and a plurality of high temperature material panels 1040 mounted thereto. The high temperature material panel 1040 can be substantially similar to that shown and described above. The high temperature material panel 1040 is retained and secured within the combustor at the second end 1044 by the second securing element 1048. The second securing element 1048 can be a ring-like structure that extends around the circumferential shape of the combustor shell 1030. In some non-limiting embodiments, the second securing element 1048 is installed after installation of the high temperature material panel(s) 1040. That is, the second securing element 1048 can be a component that clips or slides into place to engage with both the high temperature material panel 1040 and the combustor shell 1030. As illustratively shown, the second securing element 1048 can also include cooling holes 1076 that provide cooling beneath and/or into the second securing element 1048. In some embodiments, the second securing element 1048 can be shaped and configured to interface with and/or transition to a turbine vane platform in a turbine section of a gas turbine engine.

In some embodiments the second securing element 1048 is a ring-like structure that has a circumference to match with the second end 1044 of the combustor shell 1030. The second securing element 1048 can be a unitary ring or can be two or more ring segments that are attached to the combustor to secure the high temperature material panels to the combustor shell, in accordance with the present disclosure.

The various features of the present disclosure allow for effective ductility to non-ductile combustor panels. That is, the securing elements, seal dividers, and biasing elements operate to allow for the high temperature material panels to be non-ductile and thus take advantage of the very high temperatures of operation enabled by the high temperature material panels. Advantageously, embodiments of the present disclosure can provide a system for securing high temperature material panels or other non-ductile or hard to form high temperature materials within a combustor of a gas turbine engine. Advantageously, the seal dividers, the securing elements, and/or the biasing elements can be cooled, with minimal air from holes in the combustor shell. Cooling air through such holes can provide essential cooling to help the metal (i.e., combustor shell, seal divider, biasing element, securing element, etc.) from which the feature is formed to remain in the elastic deformation range of temperatures, and thus its sealing capability can be ensured and maintained at high operational temperatures.

In various embodiments, the back side of the high temperature material panels are cooled using impingement air through the combustor shell, as will be appreciated by those of skill in the art. Further, if necessary, effusion holes can be formed in and through the high temperature material panels to place additional cooling capability where needed.

The seal dividers, biasing elements, and/or securing elements can be designed to minimize possible fretting at interfaces with the high temperature material panels. Further, cooling air can be used to "separate" the seal dividers and/or the biasing elements from the high temperature material panels.

In accordance with embodiments of the present disclosure, the seal dividers, biasing elements, and securing elements can be designed to be compliant. Such compliant components can allow the high temperature material panels to move when necessary to avoid fretting. Further, in various embodiments, contact angles between the seal dividers, biasing elements, and/or securing elements can be designed to minimize local areas of high contact stress.

Advantageously, in accordance with some non-limiting embodiments, a combustor for a gas turbine engine includes high temperature material panels that are inserted into a trapping or first securing feature on the forward edge of the combustor shell. Further, spring or biasing features on the combustor shell push the high temperature material panels against the securing feature. At the aft end, a ring or second securing feature serves as a frame to hold the high temperature material panels in place. Gaps between the panels can be sealed with cooled seal dividers that can optionally serve as springs/biasing elements. In some embodiments, the seal dividers can lock into and/or be retained by the forward and/or aft securing features.

Advantageously, embodiments described herein provide combustors of gas turbine engines that have high temperature panels that may be non-ductile, but can withstand high temperatures. Embodiments of the present disclosure allow for the use of non-ductile materials as panels or tiles in a double wall combustor liner system. The securing elements ensure that there are no points of high stress. Sealing and control of the cooling air flow is maintained by features in the combustor shell and/or the seal dividers allowing the combustor panels/tiles to be simple in shape and thus easier to manufacture. By not being a full ring, the combustor panels can be made at a higher rate, with lower impact of flaws in fabrication. Further, individual panels can be replaced when failure occurs.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A combustor of a gas turbine engine comprising:

a combustor shell having a first end and a second end opposite the first end;

a first securing element positioned at the first end of the combustor shell;

a second securing element positioned at the second end of the combustor shell;

a plurality of high temperature material panels fixedly secured by the first securing element at the first end and the second securing element at the second, wherein a panel gap is formed between edges of adjacent high temperature material panels of the plurality of high temperature material panels; and a seal divider extending from the first end to the second end and positioned on the combustor shell and arranged to seal the panel gap between adjacent first and second high temperature material panels, wherein the seal divider biases the first and second high temperature material panels into secure engagement with the first and second securing elements.

2. The combustor of claim 1, further comprising a plurality of biasing elements located away from the edges of the high temperature material panels, the biasing elements biasing the high temperature material panels to secure engagement with the first and second securing elements.

3. The combustor of claim 2, wherein the biasing elements are integrally formed from the combustor shell.

4. The combustor of claim 2, wherein the combustor shell includes at least one cooling hole located proximate each biasing element to provide cooling thereto.

5. The combustor of claim 1, wherein the seal divider biases the first and second high temperature material panels into secure engagement with the first and second securing elements.

6. The combustor of claim 1, wherein the combustor shell includes at least one cooling hole located proximate the seal divider to provide cooling thereto.

7. The combustor of claim 1, wherein the high temperature material panels are formed from non-ductile materials.

8. The combustor of claim 1, wherein the high temperature material panels are formed from ceramic matrix composite.

9. The combustor of claim 1, wherein the first securing element is integrally formed with the combustor shell.

10. The combustor of claim 1, wherein the combustor shell includes at least one cooling hole proximate the first securing element to provide cooling thereto.

11. The combustor of claim 1, wherein the second securing element clips or slides into place to engage with both the high temperature material panels and the combustor shell at the second end.

12. A method of securing high temperature material panels to a combustor shell of a gas turbine engine, the method comprising:

engaging a first high temperature material panel to a first securing element positioned at a first end of a combustor shell;

positioning and engaging a second high temperature material panel to the first securing element at the first end and adjacent the first high temperature material panel;

locating a seal divider in a panel gap between the first and second high temperature material panels; and securely engaging the first and second high temperature material panels to the combustor shell with a second securing element at a second end of the combustor shell wherein the seal divider biases the first and second high temperature material panels into secure engagement with the first and second securing elements.

13. The method of claim 12, further comprising positioning a plurality of biasing elements located away from the edges of the high temperature material panels, the biasing elements biasing the high temperature material panels into secure engagement with the first and second securing elements.

14. The method of claim 13, wherein the biasing elements are integrally formed from the combustor shell or fixedly attached to the combustor shell.

15. The method of claim 12, wherein the high temperature material panels are formed from non-ductile materials.

16. The method of claim 12, wherein the high temperature material panels are formed from ceramic matrix composite.

17. The method of claim 12, further comprising integrally forming the first securing element with the combustor shell.

18. The method of claim 12, wherein the second securing element clips or slides into place to engage with both the high temperature material panels and the combustor shell at the second end.

* * * * *